US005386354A

United States Patent [19]

Osteen

[11] Patent Number: 5,386,354

[45] Date of Patent: Jan. 31, 1995

[54] ADJUSTABLE BEAM SECURITY LIGHT

[75] Inventor: Mitchell M. Osteen, Zirconia, N.C.

[73] Assignee: Regent Lighting Corporation, Burlington, N.C.

[21] Appl. No.: 169,496

[22] Filed: Dec. 17, 1993

[51] Int. Cl.[6] ..... F21V 7/16

[52] U.S. Cl. ..... 362/258; 362/280; 362/282; 362/276; 362/323; 362/371

[58] Field of Search ..... 362/282, 277, 323, 265, 362/322, 280, 276, 258, 345, 391, 221

[56] References Cited

U.S. PATENT DOCUMENTS

| | | | |
|---|---|---|---|
| 1,480,295 | 1/1924 | O'Connor | 362/280 X |
| 1,505,654 | 8/1924 | Macbeth | 362/282 X |
| 2,591,131 | 4/1952 | Brus | 362/258 |
| 2,673,282 | 3/1954 | D'Incerti | 240/1.3 |
| 3,090,589 | 5/1963 | Schaefer | 248/318 |
| 3,293,426 | 12/1966 | Zeitz et al. | 362/221 |
| 3,398,291 | 8/1968 | Zerfoss | 362/276 X |
| 3,511,985 | 5/1970 | Muscovitch | 362/282 |
| 3,949,211 | 4/1976 | Elms | 362/265 |
| 3,978,590 | 9/1976 | Wedding et al. | 33/263 |
| 4,229,781 | 10/1980 | Hitorn | 362/269 X |
| 4,410,933 | 10/1983 | Blake et al. | 362/371 |
| 4,449,168 | 5/1984 | Ewing | 362/404 |
| 4,464,707 | 8/1984 | Forrest | 362/221 X |
| 4,472,768 | 9/1984 | Quidgue | 362/370 |
| 4,527,224 | 7/1985 | Sangiamo et al. | 362/282 |
| 4,654,764 | 3/1987 | Hsiao | 362/199 |
| 4,920,459 | 4/1990 | Rothwell, Jr. et al. | 362/265 X |
| 4,924,365 | 5/1990 | Bondanous | 362/282 X |

FOREIGN PATENT DOCUMENTS

| | | | |
|---|---|---|---|
| 847948 | 9/1960 | United Kingdom | 362/282 |
| 2163246 | 2/1986 | United Kingdom | F21P 5/00 |

*Primary Examiner*—Ira S. Lazarus
*Assistant Examiner*—Thomas M. Sember
*Attorney, Agent, or Firm*—Rhodes, Coats & Bennett

[57] ABSTRACT

An adjustable beam light fixture with glare light shielding for illuminating a selected area without illuminating other areas. The adjustable beam light fixture has a reflector for holding a lamp and directing light from the same. The reflector is adjustably mounted on a housing. The mounting is accomplished by means of slots formed in the reflector and threaded fasteners extending outwardly from the housing and into the slots. The portion of the reflector adjacent the housing is arcuately shaped and a portion of the housing adjacent the reflector is arcuately shaped as well and with the same degree of arc. In the preferred embodiment, the housing includes means for mounting the adjustable beam light fixture on a surface.

30 Claims, 3 Drawing Sheets

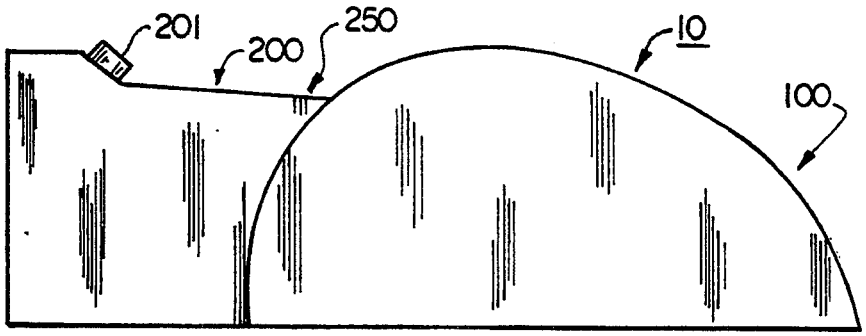
FIG. 4
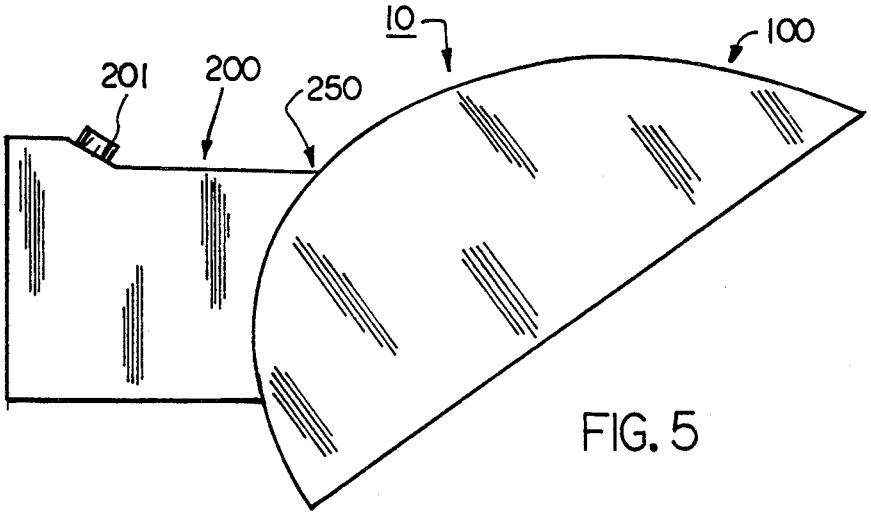
FIG. 5
FIG. 6
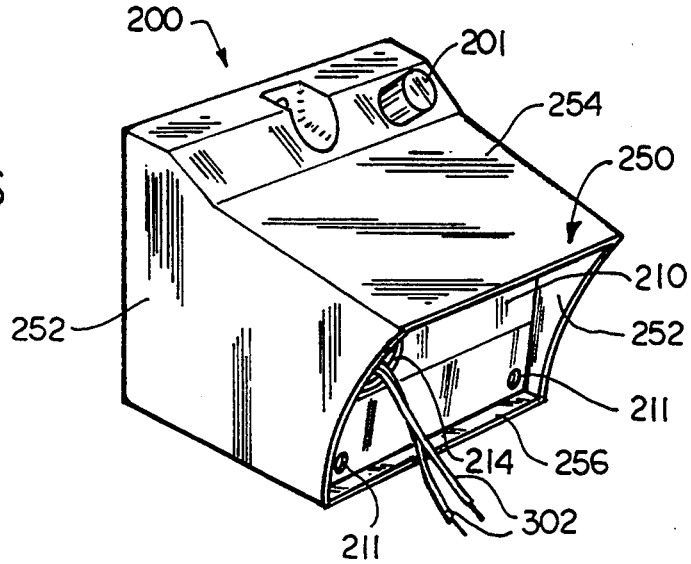

ADJUSTABLE BEAM SECURITY LIGHT

FIELD OF THE INVENTION

The present invention is directed to an outdoor security light and, in particular, to a security light of the type having an adjustable reflector for directing the light beam to desired areas and shielding the light beam from unwanted areas.

BACKGROUND OF THE INVENTION

Floodlights and similar high intensity beam outdoor and security lights are often mounted on the exterior of buildings in populated and even highly populated areas. A negative side effect of the illumination provided by these lights onto the owner's property is the spill-over of glaring light rays on neighboring property. Such light can be a substantial nuisance to neighbors. Very little has been done by the outdoor lighting industry to solve this problem. Most outdoor security lights spread light to a wide uncontrolled area. Therefore, there exist many situations in which an outdoor light having means for shielding the light beams from undesired locations would be advantageous. Preferably, such a light fixture would be adjustable for selectively choosing the location of the farthest edge of the light fixture's light beam. That is, the light fixture would be adjustable to selectively limit the maximum angle (from vertical) of light rays emitted by a lamp in the light fixture.

The prior art includes lights having adjustable beams, but none well-suited to the application described above or cost effective. U.S. Pat. No. 4,654,764 discloses a hand-held illumination device having a rotatable head. U.S. Pat. No. 847,948 shows an electric bedlamp in which the reflector is adjustable for adjusting the lamp beam, but the lamp bulb is not. U.S. Pat. No. 4,410,933 discloses a trunnion degree marker pivotally mounted on a trunnion bracket to allow for beam adjustment. U.S. Pat. No. 3,978,590 shows a device for facilitating the calibration and setting of the inclination of angle of a luminaire. U.S. Pat. No. 3,090,589 discloses a pivotal support means for pendant lighting fixtures.

Outdoor light fixtures may be fitted with photosensor means for switching the light fixture on and off. Typically, photosensors used in such applications are angled vertically or horizontally. If the photosensor is mounted vertically, it may be blocked by the eaves of a building. If the photosensor is mounted horizontally, it may be exposed to substantial amounts of light from the lamp of the light fixture. Either of the above conditions has a negative effect on the operation of the light fixture.

None of the aforesaid disclosures or any of the other prior art provides for an adjustable outdoor or security light which is efficient and effective in shielding glaring light, yet is cost-effective to manufacture. The object is to maximize the area of the owner's property that is bathed by light, yet minimize the spill-over of light onto adjacent properties. Therefore, there exists a need for an adjustable outdoor or security light having these qualities.

SUMMARY OF THE INVENTION

The present invention is a light fixture with adjustable shielding for use with a lamp. The light fixture of the present invention includes a reflector for operatively holding a lamp. The reflector has an interior surface and an exterior surface. A housing is located adjacent to and connected to the exterior surface of the reflector and is designed to hold an electromagnetic ballast and/or other components (terminals, switches, etc.). The light fixture is adjustable and cost-effective to manufacture. To this end, the reflector of the present invention is adjustably mounted to the housing. One end of the reflector has an arcuate portion adjacent the housing. The housing has a mating portion or front section that receives the arcuate portion of the reflector. In the preferred embodiment, the front section of the housing is designed to adjustably receive the reflector. The arcuate portion of the reflector is preferably of a substantially uniform arc (that is, throughout the path of the arc, each point on the arc is substantially equi-distant from a centerpoint). The length of the arcuate portion of the reflector is somewhat greater than the corresponding dimension of the housing. An adjustable connecting means for selectively adjusting the angle of the reflector relative to the housing is provided. The adjustable connecting means includes a slot formed in the reflector and a threaded fastener extending through the housing slot and into a mounting boss on the housing.

It is an object of the present invention to provide an adjustable beam security light which is adjustable for selectively fixing the location of the farthest edge of the security light's light beam.

Further, it is an object of the present invention to provide an adjustable beam security light which is adjustable to selectively limit the maximum angle (from vertical) of light rays emitted by a lamp in the security light.

It is an object of the present invention to provide an adjustable beam security light which is simply constructed, cost-effective to manufacture and conveniently adjustable.

It is an object of the present invention to provide an adjustable beam security light as described above having a reflector and a housing and in which adjustability is accomplished by means of a slot and fastener connection between the reflector and the housing.

BRIEF DESCRIPTION OF THE DRAWINGS

FIG. 4 is a side elevational view of the light fixture of the present invention with the reflector forming a part of the invention in a horizontal position.

FIG. 5 is a side elevational view of the light fixture of the present invention with the reflector forming a part of the invention in an angled position.

FIG. 6 is a perspective view of the housing forming a part of the present invention.

DESCRIPTION OF THE PREFERRED EMBODIMENT

Figure 1:
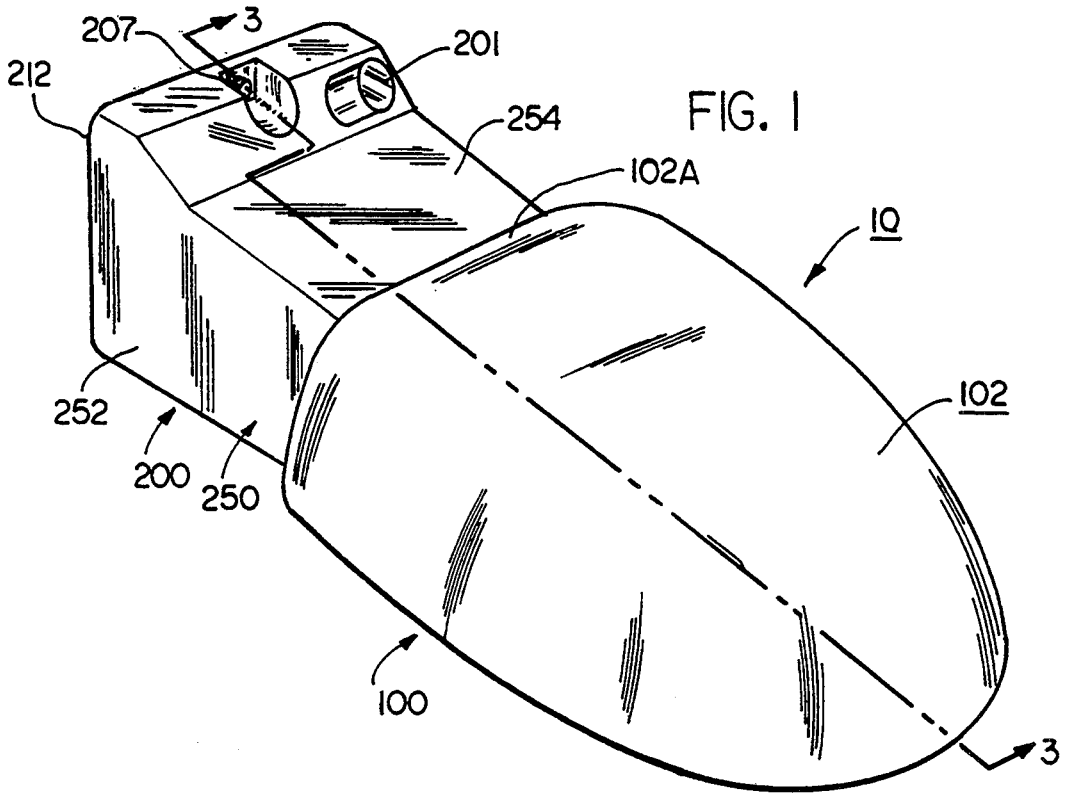
FIG. 1 is a top perspective view of the light fixture of the present invention.

In the following description, like reference characters designate like or corresponding parts throughout the several views. Also in the following description, it is to be understood that such terms as "forward", "rearward", "left" "right" "upwardly", "downwardly" and the like are words of convenience and are not to be construed as limiting terms.

The term "uniform arc", as used herein, means an arc wherein each point along the path of the arc is substantially equi-distant from a particular centerpoint.

Referring now to the drawings in general, it will be understood that the illustrations are for the purpose of describing a preferred embodiment of the invention and are not intended to limit the invention thereto.

Figure 2:
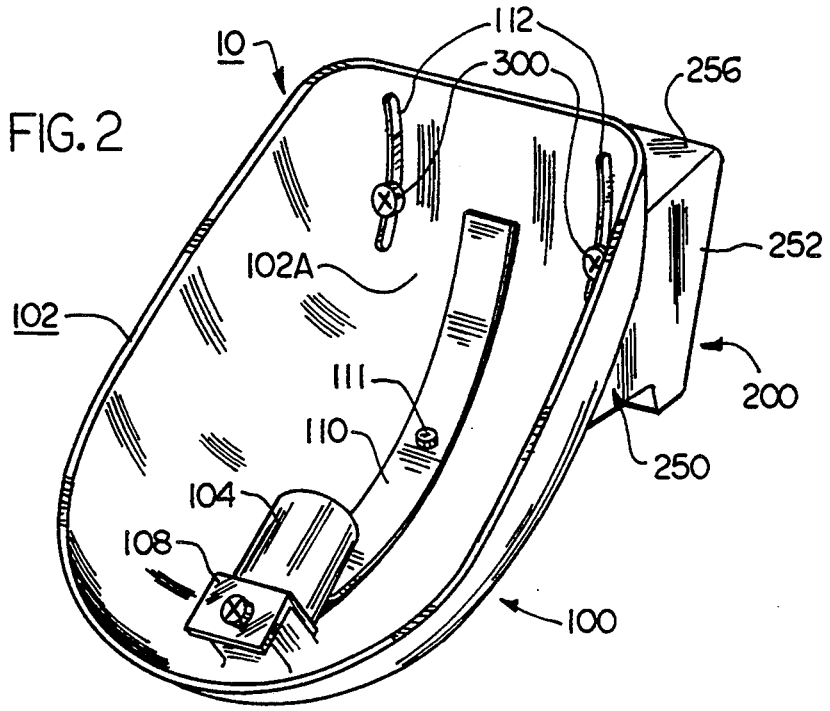
FIG. 2 is a bottom perspective view of the light fixture of the present invention.
Figure 3:
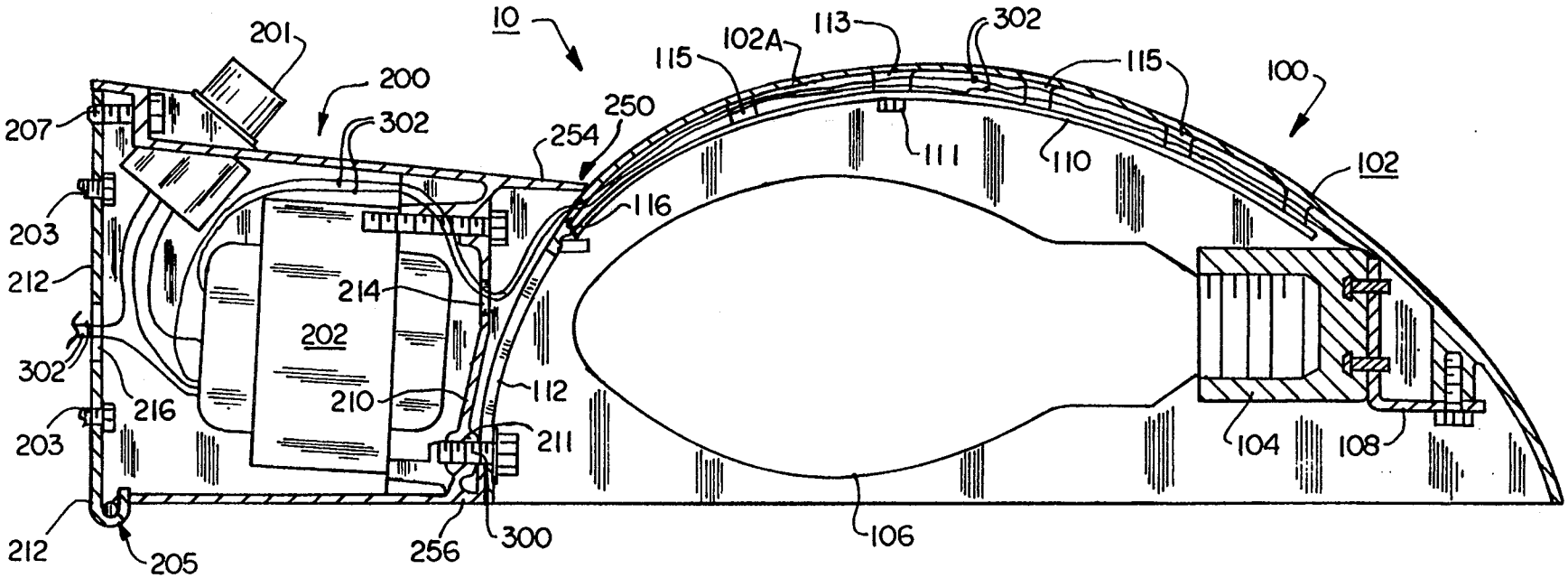
FIG. 3 is a cross-sectional view along line 3—3 the light fixture of the present invention with a lamp mounted therein.

As best seen in FIGS. 1–3 and 6, the light fixture of the present invention is shown therein and is generally denoted by numeral 10. Light fixture 10 has reflector 100, generally denoted, and housing 200, generally denoted. Reflector 100 and housing 200 are connected by adjustment bolt 300 in a manner which will be further detailed hereinafter.

Housing 200 may be constructed of cast metal, plastic, or any other suitable material. A conventional electromagnetic ballast 202 may be disposed within housing 200 and is shielded from the elements by the same. It will be understood that, depending on the type of lamp used, electromagnetic ballast 202 may be replaced with other types of ballasts or no ballast at all. In addition to or instead of ballast 202, other electrical components, such as terminals and connections, may be housed in housing 200.

Photosensor 201 is mounted on ballast housing 200 and is operable to switch light 10 on and off. Preferably, photosensor 201 is disposed at an angle of about 45% relative to horizontal. In this alignment, photosensor 201 is less likely to be blocked by eaves of a building or subjected to substantial light from the lamp.

Housing 200 has front wall 210, back wall 212, side walls 252, top wall 254, and bottom wall 256. Front wall 210 has a pair of laterally spaced threaded bosses 211 formed in the lower portion thereof. Housing 200 is designed to be attached by means of bolts 203 to a wall or other appropriate surface for mounting light fixture 10.

As shown, back wall 212 is formed separately from the rest of housing 200. Pivot assembly 205 and bolt 207 are provided for accessing ballast 202. In the preferred embodiment, back wall 212, pivot assembly 205, and bolt 207 are cooperatively designed such that when back wall 212 is closed, it is somewhat bowed toward the front of housing 200. The distortion of back wall 212 forces the middle portion thereof against the mounting surface, thereby tightening housing 200 against the mounting surface. In the alternative, back wall 212 may be formed integrally with the other walls of housing 200 or may be eliminated altogether. Back wall 212 further includes wire hole 216. Front wall 210 has wire hole 214 and bolt holes 218. Side walls 252, top wall 254, and bottom wall 256 form a front section 250. Top wall 254 extends further forward than bottom wall 256 and the forward edges of side walls 252 are curved such that, in the embodiment shown, front section 250 forms a concave seat for receiving reflector 10.

Reflector 100 has reflector structure 102 which may be formed from cast metal or any other suitable material. In the preferred embodiment, the interior surface of structure 102 is painted white, covered with some other reflective material, or formed from a reflective material. Socket support 108 is fastened to the interior of structure 102 and supports light socket 104. A lamp 106 is screwed into socket 104. Adjacent front section 250 of ballast housing 200 is arcuate section 102A of reflector structure 102. Wire hole 116 is formed in arcuate section 102A. Adjustment slots 112 are formed lengthwise in arcuate section 102A, that is, along the arc. Arcuate section 102A is longer than each of adjustment slots 112.

Wires 302 extend from outside of ballast housing 200, through wire hole 216, into and out of ballast 202, through wire hole 214, between ballast housing 200 and reflector 100, through wire hole 116, along the top of reflector structure 102 and finally into socket 104. Wire shield 110, formed of heat reflective material, is disposed between lamp 106 and wires 302 and forms a path for the latter. Wire shield 110 is secured to the interior surface of reflector 100 by bolt 111, which extends into boss 113, and the shield is spaced from reflector 100 by spacers 115.

Adjustment bolts 300 extend from the interior of reflector 100, through the slots 112 and into bosses 211 of ballast housing 200. Slots 112 are slightly wider than the diameter of the shanks of bolts 300 and narrower than the heads of bolts 300. As shown in the figures, these components are configured such that reflector 100 is slidably mounted to front wall 210 by bosses 211 and bolts 300. Notably, front section 250 of ballast housing 200 and arcuate section 102A of reflector 100 are curved with the same uniform degree of arc. Front wall 210 is recessed from the front edges of front section 250 such that it does not contact arcuate section 102A when the same is seated.

Light fixture 10 of the present invention may be adjusted as follows. With bolts 300 loosened, reflector 100 can be rotated or tilted relative to ballast housing 200. Several aspects of the light fixture are particularly noteworthy at this point. First, front section 250 and arcuate section 102A have the same uniform degree of arc. Second, arcuate section 102A is longer than adjustment slots 112. Third, top wall 254 and bottom wall 256 are positioned relative to one another so as to form a seat which will accept an arc of a given minimum size or larger. The size of the arcuate section 120A (above the minimum) that may be rotatably received in front section 250 will depend on how deeply front wall 210 is recessed within front section 250 and the curvature of side walls 252. These are design choices. The angle through which front section 102A can be rotated will also depend on the lengths of slots 112 and the extent to which the length of arcuate section 102A, which has an arc radius approximately equal to that for which front section 250 is designed, exceeds the length of front section 250.

In the preferred embodiment, the uniform arc has a radius of curvature of approximately four inches and arcuate section 102A is about twice as long as the curved edges of side walls 252. In the preferred embodiment, reflector 100 can be rotated between a zero degree (horizontal) position (FIG. 4) and a 45 degree position (FIG. 5). It will be understood that the above values will vary according to the type of lamp for which the light is designed and the amount of adjustability desired, among other factors.

Once reflector 100 has been adjusted to the desired angle, bolts 300 can be tightened by rotating the same into threaded bosses 211, securing reflector 100 in that position. FIG. 4 shows reflector 100 in a horizontal position. FIG. 5 shows reflector 100 after adjustment in an angled position. It will be understood that the reflector can be adjusted to any angle in-between.

From the foregoing description of the preferred embodiment, it will be understood that the adjustable beam security light of the present invention is adjustable for selectively choosing the location of the farthest edge of the security light's light beam. That is, security light 10 is adjustable to selectively limit the maximum angle (from vertical) of light rays emitted by lamp 106 mounted in reflector 100.

It will be understood that the directions of the arcs of the reflector and of the front section of the housing are not critical as long as they are the same. That is, as an alternative to the preferred embodiment, the front section of the housing could be convexly shaped with the arcuate portion of the reflector being concavely shaped.

The simple construction of light fixture 10 makes it cost-effective to manufacture. As shown, the socket is located opposite the ballast housing. This provides shielding from rain and the elements for the socket and bulb when reflector 100 is angled upwardly as shown in FIG.5. The socket could be located such that it is disposed between slots 112 on arcuate section 102A in order to reduce the cost of manufacturing, provided other means are incorporated for rain shielding. Notably, a refractor is not required because of the adjustability of reflector 100, but a refractor could be added if desired. Slots 112 could extend further along the length of reflector structure 102, allowing for greater range of adjustment.

Likewise, the shape of reflector 100 in the figures is only illustrative and a variety of shapes could be implemented. Other than that portion having the arcuate section, which must be of substantially uniform arc, the reflector shape is a design choice. If the interior surface of structure 102 is painted white, the shape is not particularly critical photometrically. The shape can be determined by aesthetic and rain-shielding considerations.

Certain modifications and improvements will occur to those skilled in the art upon a reading of the foregoing description. For example ribs or guides may be formed in arcuate section 102A to maintain the alignment of the heads of bolts 300. It should be understood that all such modifications and improvements have been deleted herein for the sake of conciseness and readability, but are properly in the scope of the following claims.

I claim:

1. An adjustable light fixture with glare light shielding for use with a lamp, comprising:

a. a reflector including a socket means arranged and configured to hold the lamp, said reflector having an interior surface and an exterior surface;

b. a housing adjacent said exterior surface of said reflector, said housing including a front section;

c. adjustable connecting means operable to selectively move said reflector to adjust the angle of said reflector relative to said housing through a prescribed distance of rotation; and d. a wire shield disposed between the lamp and said interior surface of said reflector, wherein said wire shield is connected to and spaced apart from said interior surface.

2. The adjustable beam light fixture of claim 1 wherein said reflector has a receiving front section adjacent said housing and said housing has an arcuate portion adjacent said arcuate portion of said reflector,

3. The adjustable beam light fixture of claim 2 wherein said arcuate portion of said reflector comprises a substantially uniform arc.

4. The adjustable beam light fixture of claim 3 wherein said arcuate portion of said reflector is greater than the corresponding front section of said housing and wherein said reflector can be selectively angularly adjusted between a first position and a second position.

5. The adjustable beam light fixture of claim 1 wherein said housing includes a ballast.

6. The adjustable beam light fixture of claim 5 wherein said housing includes means for receiving electrical wire.

7. The adjustable beam light fixture of claim 1 wherein said reflector further includes means for receiving electrical wire and means for shielding said electrical wire from heat.

8. The adjustable beam light fixture of claim 1 further including a reflective material which covers said interior surface of said reflector.

9. The adjustable beam light fixture of claim 1 wherein said housing includes means for mounting the same to a surface.

10. The adjustable beam light fixture of claim 1 wherein said adjustable connecting means includes:

a. at least one slot formed in said reflector and being at least as long as said prescribed distance of rotation;

b. at least one mounting boss in the front section of said housing;

c. a threaded fastener extending through said slot and into said housing for slidably engaging said slot.

11. The adjustable beam light fixture of claim 10 wherein said fastener comprises:

a. a shank having two ends and extending from said housing and mounted on the same at one end;

b. a head formed on the other end of said shank; and c. wherein said head is wider than said slot and said shank is narrower than said slot.

12. The adjustable beam light fixture of claim 11 wherein, when said fastener is engaged within said slot formed in said reflector, a portion of said shank is disposed within said slot and said head of said shank is disposed adjacent said interior surface of said reflector.

13. The adjustable beam light fixture of claim 12 further including tightening means for adjustably securing said head of said fastener against said interior surface of said reflector.

14. The adjustable beam light fixture of claim 13 wherein said tightening means comprises a threaded opening in said boss for receiving said threaded fastener.

15. The adjustable beam light fixture of claim 4 wherein the length of said arcuate portion of said reflector exceeds the corresponding front portion of said housing.

16. The adjustable beam light fixture of claim 4 wherein the difference between said first position and said second position is substantially 45 degrees.

17. The adjustable beam light fixture of claim 1 further including a photosensor for switching said light fixture on and off, wherein said photosensor is disposed at angle relative to horizontal.

18. An adjustable beam light fixture with glare light shielding for use with a lamp, comprising:

a. a reflector including a socket means arranged and configured to hold the lamp and having an interior surface and an exterior surface;

b. a housing adjacent said exterior surface of said reflector;

c. said reflector having an arcuate portion adjacent said housing and said housing having a front receiving portion adjacent said arcuate portion of said reflector;

d. said arcuate portion of said reflector comprising a substantially uniform arc;

e. wherein said reflector is selectively angularly adjustable between a first position and a second position relative to said housing;

f. adjustable connecting means operable to selectively move said reflector to adjust the angle of said reflector relative to said housing through a prescribed distance of rotation, wherein said adjustable connecting means includes:

(i) at least one slot formed in said reflector and being at least as long as said prescribed distance of rotation;

(ii) at least one mounting boss in the front section of said housing; and (iii) a threaded fastener extending through said slot and into said housing and slidably engaging said slot; and g. a ballast disposed within said housing.

19. The adjustable beam light fixture of claim 18 wherein said housing includes means for receiving electrical wire.

20. The adjustable beam light fixture of claim 19 wherein said reflector further includes means for receiving electrical wire and means for shielding said electrical wire from heat.

21. The adjustable beam light fixture of claim 18 further including a reflective material which covers said interior surface of said reflector.

22. The adjustable beam light fixture of claim 18 wherein said housing includes means for mounting the same to a surface.

23. The adjustable beam light fixture of claim 18 wherein said fastener comprises:

a. a shank having two ends and extending from said housing and mounted on the same at one end;

b. a head formed on the other end of said shank; and c. wherein said head is wider that said slot and said shank is narrower than said slot.

24. The adjustable beam light fixture of claim 23 wherein, when said fastener is engaged within said slot formed in said reflector, a portion of said shank is disposed within said slot and said head of said shank is disposed adjacent said interior surface of said reflector.

25. The adjustable beam light fixture of claim 24 further including tightening means for adjustably securing said head of said fastener against said interior surface of said reflector.

26. The adjustable beam light fixture of claim 25 wherein said tightening means comprises a threaded opening in said boss for receiving said threaded fastener.

27. The adjustable beam light fixture of claim 18 wherein the length of said arcuate portion of said reflector exceeds the corresponding front portion of said housing.

28. The adjustable beam light fixture of claim 27 wherein the difference between said first position and said second position is substantially 45 degrees.

29. The adjustable beam light fixture of claim 18 further including a photosensor operative to switch said light fixture on and off, wherein said photosensor is disposed at an angle relative to horizontal.

30. The adjustable beam light fixture of claim 18 further including a wire shield disposed between the lamp and said interior surface of said reflector, wherein said wire shield is connected to and spaced apart from said interior surface.

* * * * *